US008826917B2

(12) United States Patent
Park

(10) Patent No.: US 8,826,917 B2
(45) **Date of Patent: *Sep. 9, 2014**

(54) METHOD AND PRODUCT FOR ATTAINING A FRENCH MANICURE USING A DRY NAIL APPLIQUE

(75) Inventor: Fa Young Park, Leonia, NJ (US)

(73) Assignee: Park Global Holdings, LLC, Clifton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/866,678

(22) Filed: Oct. 3, 2007

(65) Prior Publication Data

US 2008/0236603 A1 Oct. 2, 2008

Related U.S. Application Data

(63) Continuation-in-part of application No. 11/543,481, filed on Oct. 5, 2006, now Pat. No. 8,092,786, which is a continuation-in-part of application No. 11/126,862, filed on May 11, 2005.

(60) Provisional application No. 60/570,713, filed on May 12, 2004.

(51) Int. Cl.
*A45D 7/00* (2006.01)
*A45D 29/00* (2006.01)

(52) U.S. Cl.
USPC ..... 132/200; 132/73

(58) Field of Classification Search
USPC ..... 132/73, 73.5, 285, 319
See application file for complete search history.

(56) References Cited

U.S. PATENT DOCUMENTS

| | | | | |
|---|---|---|---|---|
| 1,238,046 | A * | 8/1917 | Nuss | 63/43 |
| 2,013,290 | A * | 9/1935 | Rohrbach | 63/42 |
| 2,048,912 | A | 7/1936 | Ziska et al. | |
| 2,162,155 | A | 6/1939 | Calvin et al. | |
| 2,234,657 | A * | 3/1941 | Smaldone | 132/285 |
| 2,239,040 | A * | 4/1941 | Holmes | 132/285 |
| 2,581,982 | A | 1/1952 | Terry et al. | |
| 2,688,331 | A | 9/1954 | Bogoslowsky et al. | |
| 2,746,460 | A | 5/1956 | Jellinek et al, | |
| 2,764,168 | A | 9/1956 | Herz et al. | |
| 2,816,555 | A * | 12/1957 | Klump | 132/73 |
| 3,023,887 | A | 3/1962 | Cohen et al. | |
| 3,603,286 | A | 9/1971 | Scopp et al. | |

(Continued)

FOREIGN PATENT DOCUMENTS

| | | |
|---|---|---|
| CA | 2461251 | 9/2005 |
| CA | 2461251 A1 * | 9/2005 |

(Continued)

OTHER PUBLICATIONS

Office Action dated Sep. 2, 2008 in connection with U.S. Appl. No. 11/126,862.

(Continued)

*Primary Examiner* — Robyn Doan
(74) *Attorney, Agent, or Firm* — John H. Choi

(57) ABSTRACT

A dry nail tip appliqué for applying nail enamel to a nail tip. The nail tip appliqué is configured to conform to the size and shape of a respective nail tip and allows for a convenient and neat application of a French-style manicure.

9 Claims, 2 Drawing Sheets

(56) References Cited

U.S. PATENT DOCUMENTS

| | | | | | |
|---|---|---|---|---|---|
| 3,993,084 | A | | 11/1976 | Cullen | |
| 4,126,144 | A | | 11/1978 | Duarte | |
| 4,158,053 | A | | 6/1979 | Greene et al. | |
| 4,169,825 | A | | 10/1979 | Yapp et al. | |
| 4,283,324 | A | | 8/1981 | Duffy | |
| 4,511,608 | A | | 4/1985 | Ferraro | |
| 4,824,702 | A | | 4/1989 | Straub | |
| 4,903,840 | A | * | 2/1990 | So | 206/581 |
| 4,947,876 | A | | 8/1990 | Larsen | |
| 4,954,190 | A | | 9/1990 | Taeckens | |
| 5,070,892 | A | | 12/1991 | Trematerra | |
| 5,096,750 | A | | 3/1992 | Edlert et al. | |
| 5,118,495 | A | | 6/1992 | Nafziger et al. | |
| 5,206,011 | A | | 4/1993 | Pappas et al. | |
| 5,316,026 | A | | 5/1994 | Jenkins | |
| 5,415,903 | A | | 5/1995 | Hoffman et al. | |
| 5,525,389 | A | * | 6/1996 | Hoffmann et al. | 428/41.5 |
| 5,782,248 | A | * | 7/1998 | Chang | 132/200 |
| 5,866,106 | A | | 2/1999 | Papay | |
| 5,908,035 | A | | 6/1999 | Carroll et al. | |
| 6,042,679 | A | | 3/2000 | Holt et al. | |
| D445,543 | S | * | 7/2001 | A | D28/56 |
| 6,296,836 | B1 | | 10/2001 | Engler | |
| 6,303,140 | B1 | | 10/2001 | Dever et al. | |
| 6,352,687 | B1 | | 3/2002 | Ismailer et al. | |
| 6,354,304 | B1 | | 3/2002 | Chang | |
| D459,547 | S | | 6/2002 | Wada et al. | |
| 6,472,039 | B1 | * | 10/2002 | Amen-Ra A | 428/42.1 |
| 6,565,835 | B1 | | 5/2003 | Socci et al. | |
| 6,626,183 | B1 | | 9/2003 | Pietrocola et al. | |
| 6,797,261 | B1 | | 9/2004 | Le | |
| 7,143,770 | B1 | * | 12/2006 | Keller | 132/73 |
| 8,061,363 | B2 | | 11/2011 | Park | |
| 8,061,364 | B2 | | 11/2011 | Park | |
| 8,092,786 | B2 | * | 1/2012 | Park | 424/61 |
| 2002/0106493 | A1 | | 8/2002 | Komuta et al. | |
| 2002/0197435 | A1 | | 12/2002 | Amen Ra A | |
| 2003/0175225 | A1 | | 9/2003 | Leacock et al. | |
| 2003/0198611 | A1 | | 10/2003 | Glassman et al. | |
| 2003/0217758 | A1 | | 11/2003 | Mesirow | |
| 2004/0079381 | A1 | | 4/2004 | Han | |
| 2005/0061342 | A1 | | 3/2005 | Chapman | |
| 2005/0121048 | A1 | | 6/2005 | Han | |
| 2005/0150508 | A1 | | 7/2005 | Downs et al. | |
| 2005/0199253 | A1 | * | 9/2005 | Fiore et al. | 132/73 |
| 2005/0255061 | A1 | | 11/2005 | Park | |
| 2007/0025936 | A1 | | 2/2007 | Park | |
| 2008/0087291 | A1 | | 4/2008 | Jordan | |
| 2008/0236603 | A1 | | 10/2008 | Park | |
| 2008/0276951 | A1 | | 11/2008 | Park | |
| 2008/0283073 | A1 | | 11/2008 | Park | |
| 2009/0233031 | A1 | | 9/2009 | Weber et al. | |
| 2010/0047301 | A1 | | 2/2010 | Park | |
| 2010/0212681 | A1 | | 8/2010 | Park | |
| 2011/0117174 | A1 | | 5/2011 | Kergosien et al. | |
| 2012/0103354 | A1 | | 5/2012 | Park | |
| 2013/0139839 | A1 | | 6/2013 | Chang | |
| 2013/0206157 | A1 | | 8/2013 | Park | |
| 2013/0220355 | A1 | | 8/2013 | Park | |

FOREIGN PATENT DOCUMENTS

| | | | |
|---|---|---|---|
| CH | 559019 | | 12/1972 |
| FR | 1186543 | | 8/1959 |
| JP | 3243694 | | 10/2001 |
| JP | 2001353022 | | 12/2001 |
| JP | 200285148 | | 3/2002 |
| WO | 8802226 | | 4/1988 |
| WO | 8802227 | | 4/1988 |
| WO | 2005112873 | | 12/2005 |
| WO | 2008045282 | | 4/2008 |
| WO | 2011141878 | A1 | 11/2011 |
| WO | 2012021244 | A1 | 2/2012 |
| WO | WO 2012/061519 | A1 | 5/2012 |
| WO | 2013155094 | A1 | 10/2013 |

OTHER PUBLICATIONS

Office Action dated Oct. 6, 2009 in connection with U.S. Appl. No. 11/126,862.

Office Action dated Jun. 23, 2010 in connection with U.S. Appl. No. 11/126,862.

Office Action dated Jan. 21, 2011 in connection with U.S. Appl. No. 11/126,862.

Office Action dated Jan. 7, 2009 in connection with U.S. Appl. No. 11/543,481.

Office Action dated Sep. 14, 2009 in connection with U.S. Appl. No. 11/543,481.

Office Action dated Apr. 2, 2012 in connection with U.S. Appl. No. 11/543,481.

Office Action dated Feb. 14, 2011 in connection with U.S. Appl. No. 12/138,701.

Office Action dated Feb. 14, 2011 in connection with U.S. Appl. No. 12/183,385.

Office Action dated Jul. 26, 2011 in connection with U.S. Appl. No. 12/615,410.

Office Action dated Mar. 6, 2012 in connection with U.S. Appl. No. 12/615,410.

Office Action dated Aug. 23, 2012 in connection with U.S. Appl. No. 12/615,410.

Office Action dated Sep. 12, 2011 in connection with U.S. Appl. No. 12/773,135.

Office Action dated Apr. 18, 2012 in connection with U.S. Appl. No. 12/773,135.

Office Action dated Sep. 26, 2012 in connection with U.S. Appl. No. 12/773,135.

Office Action dated Mar. 30, 2010 in connection with Australian Patent Application No. 2005244843.

Office Action dated Sep. 9, 2011 n connection with Australian Patent Application No. 2005244843.

Office Action dated Jan. 25, 2010 in connection with Canadian Patent Application No. 2,566,113.

Office Action dated Jan. 26, 2011 in connection with Canadian Patent Application No. 2,566,113.

Office Action dated Mar. 6, 2012 in connection with Canadian Patent Application No. 2,566,113.

Office Action dated Dec. 18, 2012 in connection with Japanese Patent Application No. 2009-531450.

International Search Report and Written Opinion dated May 4, 2006 for International Patent Application No. PCT/US2005/016667.

International Search Report and Written Opinion dated Jun. 16, 2008 for International Patent Application No. PCT/US2007/021305.

All About Coconut Oil and Nail Fungus. http://nailfungustreatmentguide.org/coconut-oil-nail-fungus/ (Aug. 11, 2011).

Office Action dated Jun. 7, 2013 for U.S. Appl. No. 12/615,410.

Office Action dated Sep. 26, 2012 for U.S. Appl. No. 13/287,880.

Office Action dated Jul. 11, 2013 for U.S. Appl. No. 13/287,880.

Office Action dated Jun. 3, 2013 for Korean Application No. 10-2013-7002868.

International Search Report and Written Opinion dated Mar. 16, 2013 for International Patent Application No. PCT/US2011/059000.

International Search Report and Written Opinion dated Jul. 31, 2013 for International Patent Application No. PCT/US2013/35817.

Office Action dated Apr. 9, 2013 in connection with Canadian Patent Application No. 2,566,113.

Office Action dated Dec. 28, 2011 in connection with Korean Application No. 10-2006-7026131.

Office Action dated Sep. 28, 2012 in connection with Korean Application No. 10-2006-7026131.

Office Action dated Jul. 14, 2008 in connection with Russian Application No. 2006138905/15.

Office Action dated Feb. 24, 2011 in connection with Russian Application No. 2010107190/12.

* cited by examiner

METHOD AND PRODUCT FOR ATTAINING A FRENCH MANICURE USING A DRY NAIL APPLIQUE

RELATED APPLICATIONS

The current application is a Continuation-In-Part of U.S. patent application Ser. No. 11/543,481 filed Oct. 5, 2006 now U.S. Pat. No. 8,092,786 which is itself a Continuation-In-Part of U.S. patent application Ser. No. 11/126,862, filed on May 11, 2005, which claims domestic priority from U.S. Provisional Patent Application No. 60/570,713, filed on May 12, 2004. The contents of all of the above-mentioned patent applications are incorporated by reference herein.

FIELD OF THE INVENTION

The current invention relates generally to the field of nail polish, more specifically, to a novel method and apparatus for attaining a French-style manicure using an instant dry film nail polish application.

BACKGROUND OF THE INVENTION

The use of an instant fingernail coating product whereby nail polish is applied to a fingernail by adhesively securing to it a dry form of nail polish has become a preferred mode of attaining a manicure by many users. Such dry nail polish products are disclosed in U.S. Pat. Nos. 4,903,840 and 5,415,903 each of which is incorporated by reference herein.

The nail coating product, or instant nail polish referenced above, confers numerous advantages over conventional, prior art nail polish applied with a brush in a liquid form. The application of instant nail polish is faster, easier and cleaner than conventional nail polish and does not suffer from the numerous encumbrances associated with wet nail polish such as drying time and the concern of smearing or smudging.

However, the previous dry nail coating products are not well adapted to applying a French-style manicure, wherein the tips of nails are coated with an enamel of a color that is different from the rest of the nail. Specifically, U.S. Pat. No. 4,903,840 discloses a dry nail coating application that is pre-printed with a design or a different color tip portion. Attaining a French-manicure with the pre-printed configuration is difficult, requires precision and is prone to imperfection. U.S. patent application No. 543,481 discloses a novel nail appliqué in which a single nail appliqué is divisible into two separate portions—one to coat the entirety of a nail and a second one to coat only the nail's tip. It would be desirable, however, to fashion a nail tip coating appliqué that is a separate member, independent and apart from a nail coating appliqué.

SUMMARY OF THE INVENTION

The present invention is directed to a novel French-style dry nail coating appliqué and a method of applying the same wherein a tip portion is configured as a separate, independent member that is adapted to coating the tip of a nail. This allows for the easy and neat application of a dry, French-style manicure, which presents an improvement upon the pre-printed configuration of the prior art, and is independently useful for applying French tips.

The inventive nail tip coating appliqué ("nail tip appliqué" herein) comprises a substantially crescent or rounded dry nail product. After applying a dry nail coating of liquid nail polish to a fingernail, the separate nail tip appliqué described herein is then utilized to add a second coat to the nail's tip. Preferably, the nail tip application is of a different color or shade from that of the rest of the nail. The rounded curvature of the inventive nail tip appliqué is adapted to conform to the rounded shape and size of a nail tip.

Numerous advantages are realized with the inventive nail tip appliqué. The application of a French manicure using liquid nail polish entails applying a first coating of polish over the entire surface of a nail and waiting for the first coat to dry before applying a second coat of nail polish in a fine, neat strip across the tip of the nail. This process is time consuming, requites dexterity and is expensive when done at a nail salon. The nail tip appliqués described herein mitigates these problems with an easy tip coating applicator that requires minimal drying time, is pre-cut to conform to the shape of a nail tip and is easy to apply The nail tip appliqué could be used on nails coated with ordinary liquid nail polish or with the dry nail coating products referenced herein.

DETAILED DESCRIPTION OF THE INVENTION

Figure 1:
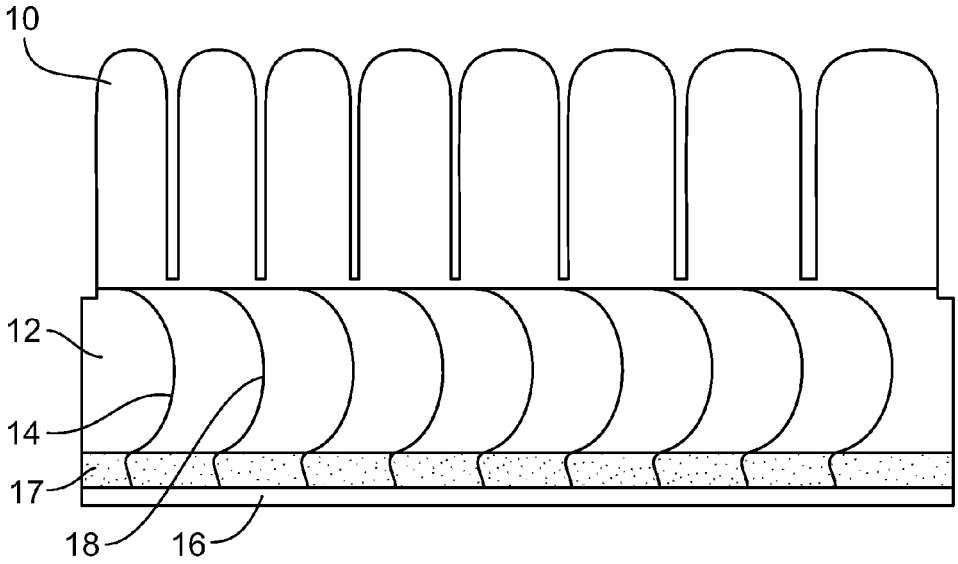
FIG. 1 shows an embodiment of the invention wherein the nail tip appliqués are attached to a strip of nail appliqués.

The following is a detailed description of the preferred embodiments of the invention, reference being made to the drawings in which the same reference numerals identify the same elements of structure in each of the several figures.

Referring to FIG. 1, a strip of nail appliqués 10 similar, or identical to those referenced above herein is accompanied by a plurality of the inventive nail tip appliqués 12. Each nail tip appliqué 12 contains a section that is rounded or curved 14 and therefore adapted to conform to the shape of a nail tip. In a preferred embodiment a series of nail tip appliqués 12 is fixed to a backing sheet of material 16 and the appliqués are separated from one another by way of a kiss cut 18. The kiss cut, which perforates the nail tip appliqué but not the underlying backing, allows for nail tip appliqués 12 to be removed from the backing 16 on an individual basis. Preferably, strips of material that is in communication with nail tip appliqués function as a tabs 17, which can be pulled to facilitate the removal of nail tip appliqué 12 from their backing 16.

In an embodiment, a thin sheet of backing material such as paper, for example, is coated with an adhesive coating. A uniform layer of partially cured nail polish material in the general shapes of nail tips is deposited on the backing material forming a film of nail polish. When the film of nail polish or nail appliqué is removed from the backing, it has an adhesive surface, which can be adhesively secured to a fingernail by placing it and pressing on the nail.

It is anticipated that the inventive nail tip appliqué can be produced using the formulations and methods of manufacture described in the patents and patent disclosures incorporated by reference herein. The nail tip appliqué mentioned herein refers to the finished nail coating product comprising nail polish material and an adhesive means which is sized and shaped to substantially conform to the rounded edge of a fingernail tip.

Figure 2:
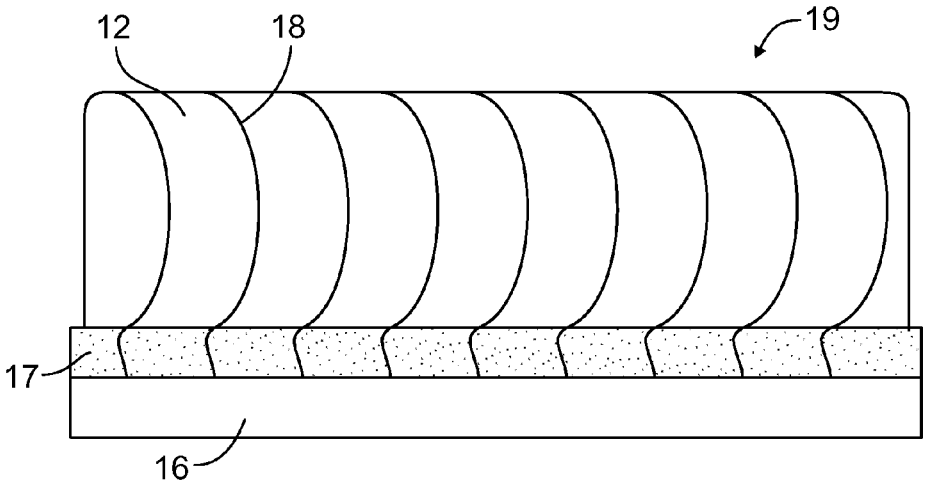
FIG. 2 shows a strip of nail tip appliqués.

In a preferred embodiment, a plurality of nail appliqués 10 and a plurality of nail tip appliqués 12 are removably affixed to a common paper backing 16. However, as illustrated in FIG. 2, a strip of nail tip appliqués 12 can be produced, packaged and sold independent of nail appliqués 10.

In a preferred embodiment, a plurality of nail tip appliqués are secured to a paper backing in a substantially linear fashion such that the convex-like border 22 of one tip coating abuts the concave-like border 20 of an adjacent tip coating 19. In an embodiment, the concave 20 and convex 22 portions are defined by a kiss cut 18. In one embodiment, a plurality of tip coatings disposed in a linear configuration accompanies a plurality of nail coatings, preferably with the nail coatings 10 and tip coatings 12 sharing a common backing.

In a preferred embodiment, a plurality of nail tip appliqués are cut, each having varying degrees of curvature 14, preferably substantially corresponding to the varying curvatures of the various fingernails.

Figure 3:
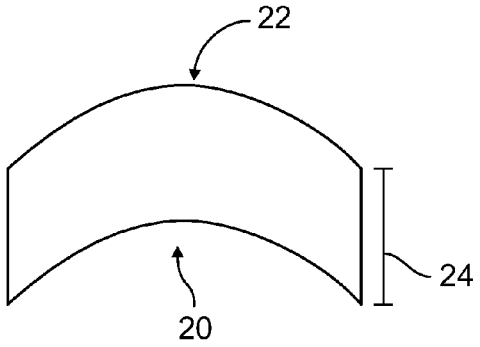
FIG. 3 shows a single nail tip appliqué.

Referring to FIG. 3, a single nail tip appliqué is preferably a crescent-like shaped strip that has a substantially concave-like edge 20 and an opposing substantially convex-like edge 22 which respectively comprise the top and bottom borders of the strip. The sides of the strip are preferably delineated by straight-cut edges 24 that are substantially parallel to each other. The sides 24, and therefore the depth of the strip, are preferably about a halt of an inch. It will be understood by those of ordinary skill in the art that a nail tip appliqué can be configured in any of various sizes and shapes so long as it possesses a rounded section that is adapted to substantially conform to the curvature of a respective fingernail tip.

Nail tip appliqués can be utilized by wearers of traditional liquid nail polish, for example, as an easier, neater and more convenient way of applying a French tip. Additionally, people who wish to have their nails done at a nail salon, but do not want to spend time waiting for two applications of polish to dry, can buy a strip of nail tip appliqués for self-applying French tips.

Figure 4:
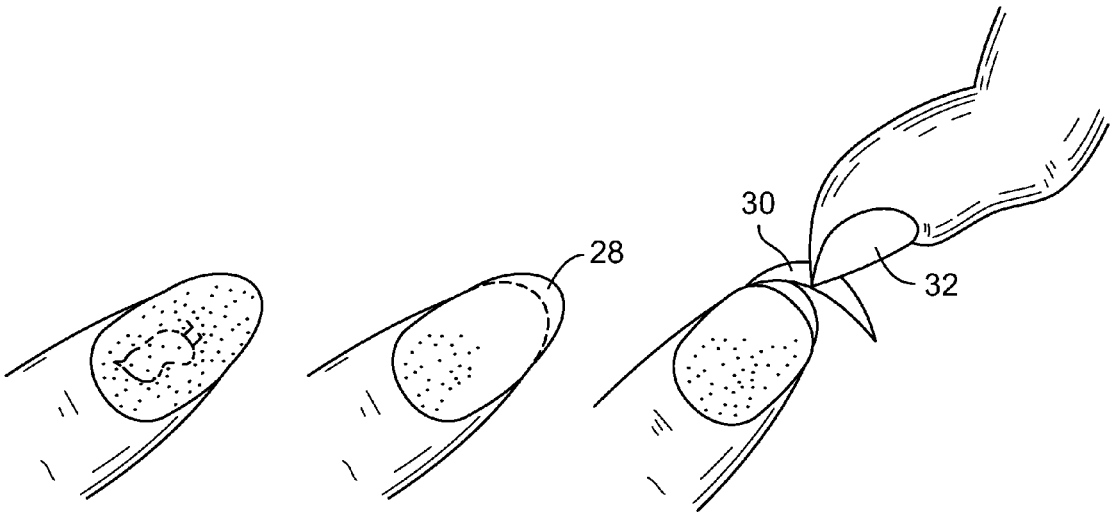
FIG. 4 is an illustration depicting a method of applying the nail tip appliqué.

In FIG. 4, a single nail tip appliqué 12 is removed from its paper backing 16. Beginning with a nail that has already been coated with a nail coating (via a dry application or otherwise), the nail tip appliqué is secondarily placed on a portion of a nail tip to be coated 28. The nail tip appliqué is adhesively secured to the fingernail tip by firmly pressing on it. Any portion that may extend beyond the edge of the nail 30 is easily removed by shearing it, for example, with another fingernail 32 or with a shearing instrument.

Alternatively, the nail tip appliqué could be applied first and a coating of the rest of the nail (including the tip portion) could be applied secondarily.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A method of applying a French manicure to a fingernail, comprising the steps of:

a. providing a nail tip appliqué, said nail tip appliqué comprising nail enamel, said nail tip appliqué having a concave shaped edge, said concave shaped edge being shaped to substantially conform to the curvature of a nail tip;

b. placing said nail tip appliqué on a portion of a tip of said fingernail;

c. pressing on said nail tip appliqué and adhering said nail tip appliqué to said portion of said tip;

d. shearing off a portion of said nail tip appliqué which extends past beyond the edge of said fingernail;

e. applying a nail polish appliqué to said fingernail, said nail polish appliqué coating said entire fingernail and covering said nail tip appliqué previously applied to said tip.

2. The method of claim 1, wherein a nail polish appliqué is applied to an entire fingernail and steps a-d are performed thereafter.

3. The method of claim 1, wherein said shearing step is performed with the use of a shearing tool.

4. The method of claim 1, wherein said shearing step is performed with the use of a fingernail.

5. The method of claim 1, wherein said nail tip appliqué includes an adhesive material located on a surface thereof.

6. The method of claim 5, wherein said nail tip appliqué includes a convex edge positioned opposite said concave shaped edge.

7. The method of claim 6, wherein said nail tip appliqué includes first and second side edges extending between said concave shaped edge and said convex edge in a substantially linear manner.

8. The method of claim 1, wherein said nail tip appliqué is removably attached to a backing, said nail tip appliqué being removed from said backing prior to the performance of said placing step.

9. The method of claim 8, wherein said nail polish appliqué is removably attached to said backing, said nail polish appliqué being removed from said backing prior to the performance of said application step.

* * * * *